United States Patent [19]

Voss et al.

[11] Patent Number: 4,693,398

[45] Date of Patent: Sep. 15, 1987

[54] DISPENSING CONTAINER

[76] Inventors: Klaus-Wilhelm Voss; Werner Kluj, both c/o Vosschemie GmbH, Esinger Steinweg 50, Postfach 1355, 2082 Uetersen - Bei Hamburg, Fed. Rep. of Germany

[21] Appl. No.: 275,728

[22] Filed: Jun. 22, 1981

[51] Int. Cl.[4] ..... B67D 5/54

[52] U.S. Cl. ..... 222/327; 222/389

[58] Field of Search ..... 222/326, 327, 389

[56] References Cited

U.S. PATENT DOCUMENTS

| | | | |
|---|---|---|---|
| 1,961,554 | 6/1934 | Dodge | 222/326 |
| 2,294,954 | 9/1942 | Brady | 222/326 X |
| 3,220,616 | 11/1965 | Jennings | 222/327 |
| 3,456,849 | 7/1969 | Sjostrand | 222/327 X |

*Primary Examiner*—F. J. Bartuska

*Attorney, Agent, or Firm*—James W. Pearce; Roy F. Schaeperklaus

[57] ABSTRACT

A dispensing container having an annular side wall and a lower end wall closing a lower end of the side wall. The lower end wall is provided with a discharge opening which is spaced a selected distance from a center of the lower end wall. The lower end wall is spaced upwardly from a lower edge of the side wall to form a circular space inside a lower end portion of the side wall. A circular support plate of a dispensing machine is received in the space, and the opening in the lower end wall is keyed to an opening in the support plate by complementary frusto-conic wall sections at the openings so that only a container which keys to the support plate can be used with the dispensing machine.

4 Claims, 4 Drawing Figures

DISPENSING CONTAINER

This invention relates to a container for plastic material. More particularly, this invention relates to a container having a discharge opening for use with a machine for dispensing the plastic material from the container.

An object of this invention is to provide a container of plastic material which is arranged for use only with a particular form of dispensing machine.

A further object of this invention is to provide such a container which, when mounted on the dispensing machine, is keyed to the machine in dispensing position.

Briefly, this invention provides a hollow cylindrical container having a main opening in an upper end thereof through which a plunger can be introduced. A discharge opening is formed in a lower end plate of the container for discharge of the contents of the container as the plunger is advanced along the container. The opening is spaced from the center of the container a selected distance. Walls of the discharge opening extend downwardly from the lower end plate to cooperate with a discharge fitting in a support plate of the dispensing machine to key the opening in the lower end plate to the discharge fitting so that contents of the container can be discharged through an opening of the discharge fitting. The lower end plate is spaced upwardly of a lower edge of the container, and side walls of the container extend downwardly beyond the lower end plate so that, when the container is supported on its lower edge, the walls of the discharge opening are spaced above a supporting surface.

The above and other objects and features of the invention will be apparent to those skilled in the art to which this invention pertains from the following detailed description and the drawings, in which.

In the following detailed description and the drawing, like reference characters indicate like parts.

Figure 1:
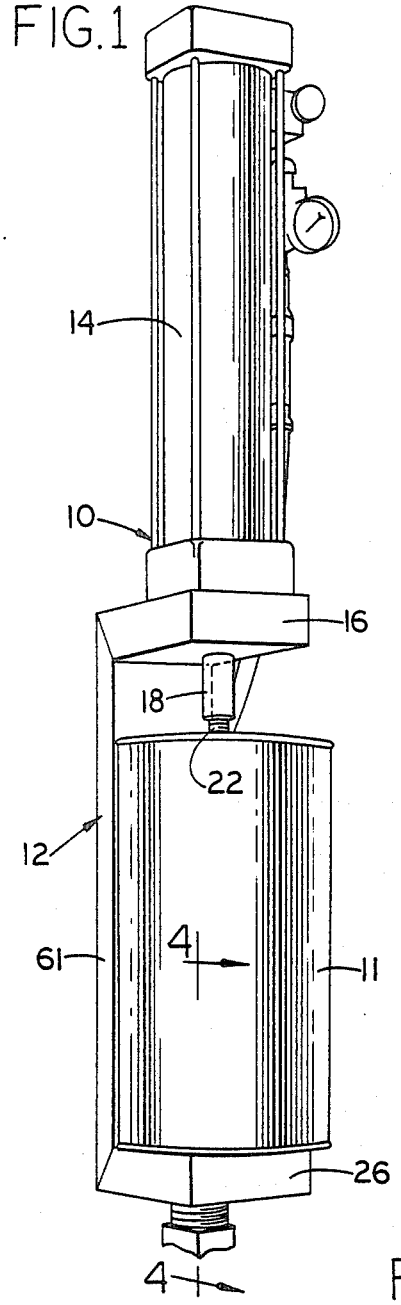
FIG. 1 is a perspective view of a dispensing machine equipped with a dispensing container constructed in accordance with an embodiment of this invention.
Figure 2:
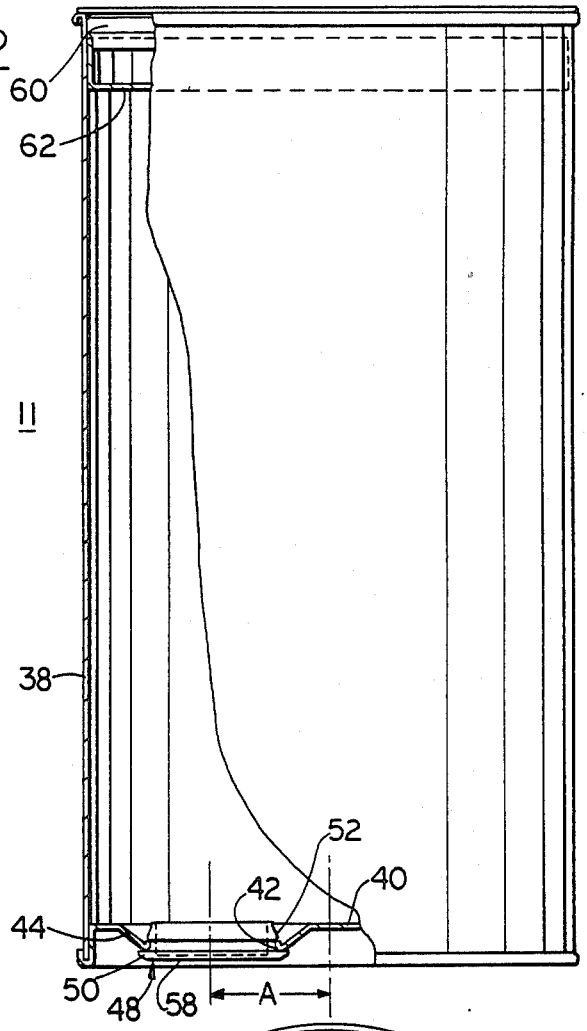
FIG. 2 is a view in side elevation of the dispensing container partly broken away and in section to show internal details.
Figure 3:
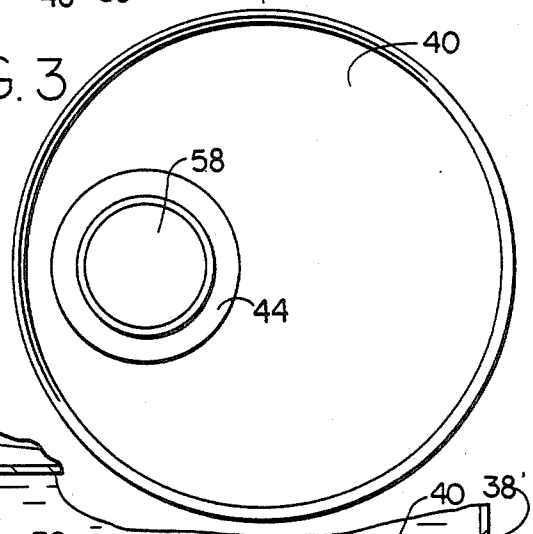
FIG. 3 is a bottom plan view of the dispensing container.

In FIG. 1 is shown a dispensing machine 10 which is arranged to dispense plastic material such as body filler from a container 11. The machine 10 includes a channel shaped main frame 12, which can be supported by an appropriate bracket, not shown. A cylinder 14 is mounted on an upper flange 16 of the main frame 12. A piston rod 18 is actuated by a piston (not shown) which works in the cylinder 14. The piston rod 18 carries a circular plate 20, which is threaded to a lower extension 22 of the piston rod 18. A lock nut 24 holds the plate 20 in position on the extension 22.

A lower flange 26 of the main frame 12 carries a pipe 27 through which contents of the container 11 can be discharged. An upper end portion 28 of the pipe 27 extends upwardly above the upper face of the flange 26. A circular support plate 30 is mounted on the flange 26 by means of appropriate fasteners 32, only one of which is shown. A socket 34 in the plate 30 receives the upper end portion 28 of the pipe 27. The socket 34 has a frusto-conic upper wall section 36.

Figure 4:
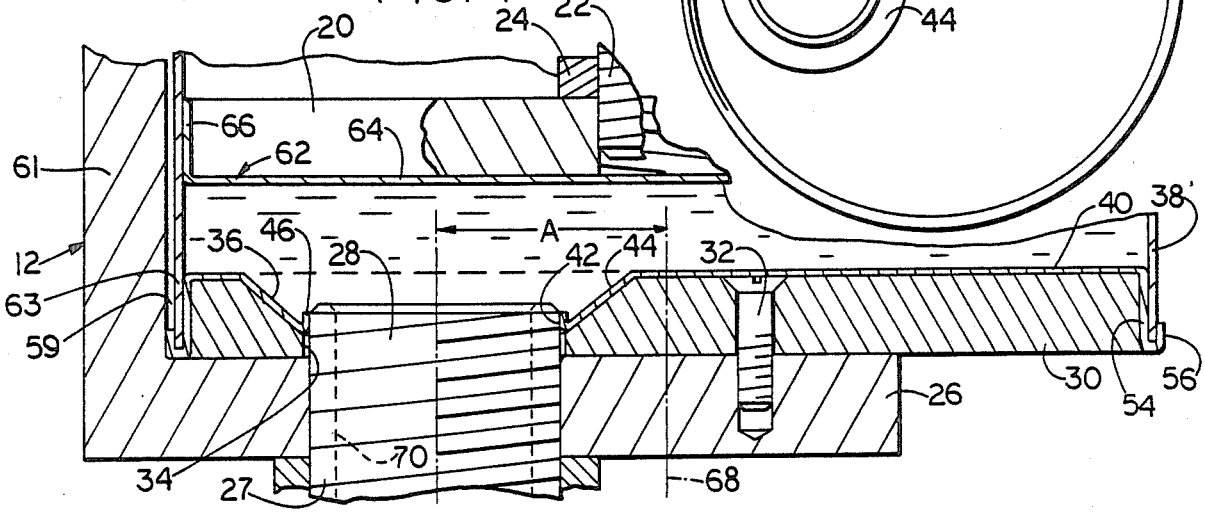
FIG. 4 is a fragmentary view in section taken on the line 4—4 in FIG. 1.

The container 11 includes a cylindrical outer or side wall 38. A lower plate 40 spans the outer wall but is spaced upwardly from a lower edge of the outer wall 38. An opening 42 is formed in the lower plate 40. The opening 42 is provided with a downwardly and inwardly extending frusto-conic wall section 44 which terminates in an upwardly extending edge flange 46. A cap 48 of resilient plastic or rubberlike material can fit into the opening 42 to close the opening 42. The cap 48 includes an outer flange 50 which can engage the lower edge of the frusto-conic wall section 44 and an inner flange 52, which can engage the upper edge of the edge flange 46. At the outer edge of the lower plate 40 is provided a downwardly extending flange 54 which terminates in a return bend 56. The return bend 56 is crimped in a lower edge portion of the outer side wall 38. The plane of the lower edge of the flange 54 is below a lower face 58 of the cap 48 so that the container 11 can rest on the flange 54 while the cap 48 is undisturbed. As shown in FIG. 4, there is a space 59 between the support plate 30 and a web 61 of the main frame 12. The flange 54, the return bend 56 and a lower end portion 63 of the outer wall 38 are received in the space 59.

The upper end portion of the outer wall 38 is arranged to receive a removable lid 60. Inside the lid 60 is mounted a pressure plate 62 including a base plate portion 64 and an upwardly extending edge flange 66.

The diameter of the plate 30 can be substantially equal to the diameter of the lower plate 40 inside the flange 54 so that, when the cap 48 has been removed from the plate 40, the container 11 can be mounted on the plate 30 with the frusto-conic wall section 44 of the lower plate 40 fitting inside the frusto-conic upper wall section 36 of the open1ng 42 of the lower plate 40 and the flange 46 of the plate 40 engaging the upper end portion 28 of pipe 27. The opening 42 can be a selected distance A from a center line 68 of the plate 30 so that only a container with an opening placed the selected distance A from the center line thereof can properly be fitted onto the plate 30. Then, when the lid 60 is removed, the rod 18 and the plate 20 can be lowered to cause the plate 20 to engage a base plate portion 64 of the pressure plate 62, as shown in FIG. 4, to advance the plate 20 and the pressure plate 62 downwardly and cause discharge of the contents of the container 11 through a central opening 70 of the pipe 28.

The container illustrated in the drawing and described above is subject to structural modification without departing from the spirit and scope of the appended claims.

Having described our invention, what we claim as new and desire to secure by letters patent is:

1. In combination with a dispensing container which comprises an annular side wall and a lower end wall closing a lower end of the side wall, the lower end wall being spaced upwardly of a lower edge of the side wall, there being a discharge opening in the lower end wall spaced a selected distance from a center of the lower end wall, a frame, a support member mounted on the frame and received in the space inside a lower end portion of the side wall, there being a space below the lower end wall and inside the lower end portion of the side wall for receiving the support member, means for keying the discharge opening to an opening in the support member, a pipe member mounted in the frame and extending through the opening in the support member, the opening in the support member being a distance from the center of the support member equal to the selected distance, and means for urging contents of the container downwardly, the pipe member receiving contents of the container.

2. The combination of a dispensing container which comprises an annular side wall, a lower end wall closing a lower end portion of the side wall, there being a discharge opening in the lower end wall spaced a selected distance from a center of the lower end wall, the lower end wall being spaced upwardly of a lower edge of the side wall to form a space below the lower end wall and inside a lower end portion of the side wall with a dispensing machine comprising a frame, a support plate mounted on the frame and received in the space inside the lower end portion of the side wall, there being an opening in the support plate a distance from the center of the support plate equal to the selected distance, means for urging contents of the container downwardly, and means for keying the opening in the lower end wall of the container to the opening in the support plate so that contents of the container are discharged through the opening in the support plate.

3. A combination as in claim 2 in which the lower end portion of the side wall is circular and the support plate is circular and of substantially the same diameter as the inside of the lower end portion of the side wall so that the container can be turned to align the opening in the lower end wall of the container with the opening in the support plate.

4. A combination as in claim 2 in which the keying means includes an upwardly and outwardly extending frusto-conic wall section on the support plate surrounding the opening thereof and an upwardly and outwardly extending frusto-conic wall section on the lower end wall surrounding the opening thereof, the frusto-conic wall sections being complementary and engaging to key the openings together.

* * * * *